United States Patent [19]

Vassiliou

[11] Patent Number: 4,636,402

[45] Date of Patent: Jan. 13, 1987

[54] METHOD OF COATING HOLLOW MASSIVE OBJECTS WITH PLASTISOLS AND ORGANOSOL

[75] Inventor: Eustathios Vassiliou, Newark, Del.

[73] Assignee: E. I. Du Pont de Nemours and Company, Wilmington, Del.

[21] Appl. No.: 828,977

[22] Filed: Feb. 13, 1986

[51] Int. Cl.[4] ..... B05D 3/14

[52] U.S. Cl. ..... 427/49; 427/335; 427/377; 427/388.1

[58] Field of Search ..... 427/49, 335, 377, 388.1

[56] References Cited

U.S. PATENT DOCUMENTS 2,953,818 9/1960 Bartron .
3,139,470 6/1964 Prengle et al. .
3,874,898 4/1975 McInnes et al. .

*Primary Examiner*—Bernard D. Pianalto
*Attorney, Agent, or Firm*—Richard H. Burgess

[57] ABSTRACT

A process for curing a coating of plastisol or organosol on a hollow massive object by maintaining sufficient concentration of latent solvent in and near the coating to permit coalescence of the coating at temperatures above the boiling point of the latent solvent. Internal heating of the object is used.

7 Claims, 4 Drawing Figures

METHOD OF COATING HOLLOW MASSIVE OBJECTS WITH PLASTISOLS AND ORGANOSOL

BACKGROUND

The present invention provides a method of curing a coating of plastisol or organosol on a massive object. More particularly, the method involves keeping latent solvent in the vicinity of the coating at elevated temperatures.

Polyvinylchloride (PVC) is generally made into coatings by means of plastisol or organosol technology. Plastisol technology involves the use of plasticizers. Polyvinyl fluoride (PVF) coatings are generally made by using organosol technology.

PVF organosols are made by suspending fine powder PVF in latent solvent which does not dissolve the PVF at room temperature (26° C.) but does go through two phases as temperature is increased. First a gel is formed at intermediate temperatures, and then, with increased heating, a true solution is formed. Coating coalescence starts at the gel temperature and proceeds more rapidly with increasing temperature. Of course, when a solution is formed and the solvent later evaporates, coalescence is complete. One difficulty is that certain latent solvents for PVF are quite volatile or even boil at atmospheric pressure at temperatures near or even below the gel and solution temperatures. This can make it particularly difficult to coalesce coatings onto massive objects, particularly if they are heated from the outside. The problem is that the latent solvents evaporate from the outer layers of the coating composition before the inner layers are at high enough temperatures for long enough to gel and coalesce.

Polyvinyl fluoride (PVF) is generally not soluble at room temperature in conventional solvents, however, it can be put into solution with so called latent solvents. A dispersion of PVF powder is suspended in latent solvent and heated to a first temperature at which a gel is formed and then to a higher second temperature at which a solution is formed. The heating can be done continuously without stopping at the first temperature. Latent solvents and other technology useful in handling PVF are discussed in U.S. Pat. No. 2,953,818—Barton (Sept. 27, 1980) and U.S. Pat. No. 3,139,470—Prengle et al. (June 30, 1964), both incorporated herein by reference.

SUMMARY OF THE INVENTION

The invention comprises a process for coating a hollow object with a plastisol or an organosol coating composition containing a solvent wherein the hollow object is coted on the outside with the composition, the object is heated internally so that the object itself reaches temperatures for curing the coating before or not later than the outer layers of the coating, and an atmosphere of latent solvent is maintained in contact with the coated surfaces of the object during curing. Preferably the latent solvent- evaporating from the coating is maintained in contact with the coated surface by a sealed enclosure having surfaces proximate to the coated surface. A solvent rich atmosphere is desired.

In another preferred embodiment, the latent solvent is maintained in contact with the coated surface by adding latent solvent to the atmosphere in the enclosure from an external source.

Preferred coating compositions of the invention are organosols comprising polyvinyl fluoride (PVF) and latent solvents.

DETAILED DESCRIPTION

Figure 1:
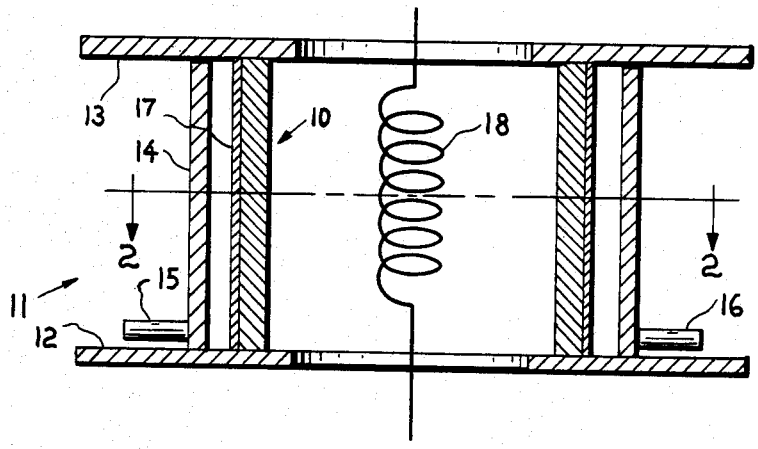
FIG. 1 is a vertical cross section of part of a heating apparatus with a hollow massive object in place for the curing of a coating according to the invention.
Figure 2:
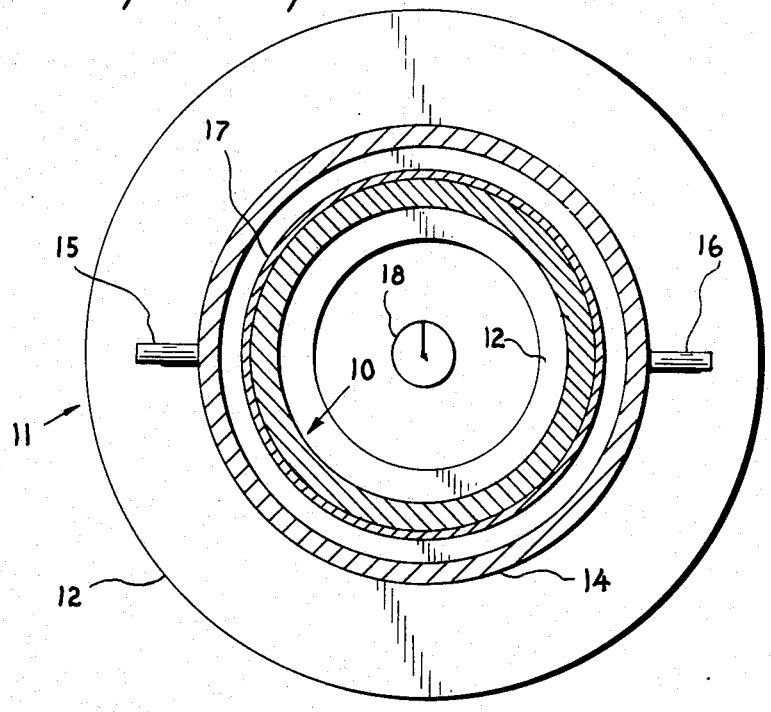
FIG. 2 is a horizontal cross section through FIG. 1 at cutting plane 2—2.

In a preferred embodiment of the invention, illustrated in FIG. 1, hollow massive object 10, here in the form of a cylinder, is placed in a furnace chamber, the relevant parts of which are indicated at 11. The chamber comprises bottom 12 and top 13 which are in contact with and provide some seal to the ends of object 10. The chamber also has housing 14 which is in close proximity to object 10 so that the latent solvent which evaporates from coating composition 17 on the outer surface of object 10 is kept in the vicinity and not permitted to escape. Heating means such as electrical resistance heater 18 are provided inside object 10, although hot air, other electrical means, or other techniques could also be used for heating. Ports 15 and 16 are available in case the operator chooses to provide pressurized latent solvent from external sources to maintain the atmosphere of latent solvent in contact with the coating composition as it cures.

While generally not necessary, latent solvent could be added to the oven for the process of the invention.

Figure 3:
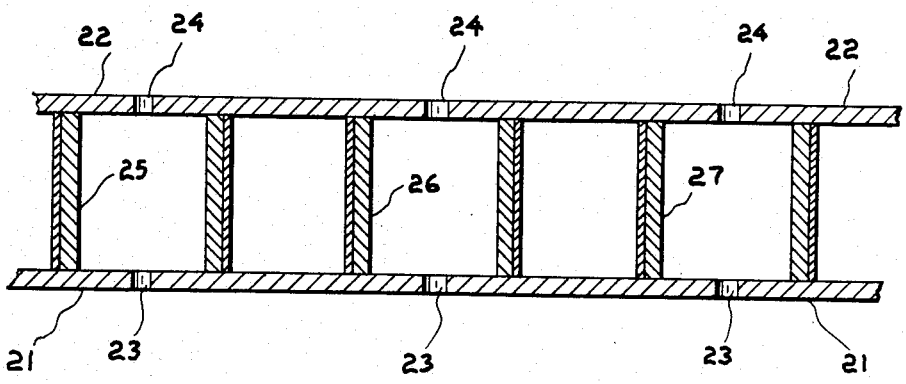
FIG. 3 is a vertical cross section representative of an apparatus for curing coatings on multiple objects.
Figure 4:
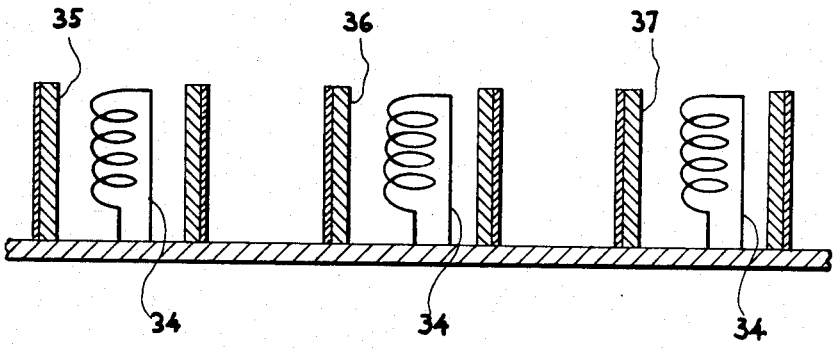
FIG. 4 is a vertical cross section representative of apparatus for another method of curing coatings on multiple objects.

FIG. 3 illustrates a furnace for heating multiple hollow objects 25, 26 and 27 according to the invention, with hot gases provided through holes such as 23 and 24 in furnace bottom 21 and top 22. Alternatively, FIG. 4 shows electrical resistance heating elements 32, 33 and 34 inside hollow objects 35, 36 and 37 on furnace bottom 31.

Without using internal heating and maintaining an atmosphere of latent solvent, wet coating compositions of organosols and plastisols tend to dry prematurely from the outside in, leaving a powdery uncoalesced layer rather than a melt-formed film.

EXAMPLE

Coating compositions for preferred use in the present invention include, in parts by weight

| | |
|---|---|
| propylene carbonate and/or gamma butyrolactone | 67 |
| polyvinyl fluoride powder | 33 |

Objects such as metal cylinders 5 cm in diameter and 15 cm long with an 0.5 cm wall thickness are coated by appropriate techniques with such compositions, then the objects are placed in a furnace or oven in accordance with the invention and heated preferably to 205°-230° C. in an oven set at 260° C. for 30 minutes for preliminary curing. Then the objects are removed from the oven and heated in a conventional oven at 175°-230° C. for 5 to 30 min., depending on the thickness of the coating and the cure desired.

I claim:

1. A process for coating a hollow object with a plastisol or organosol coating composition containing a solvent wherein the hollow object is coated on the outside with the composition, the object is heated internally so that the object itself reaches temperatures for curing the coating before or not later than the outer layers of the coating, and an atmosphere of latent solvent is maintained in contact with the coated surface of the object during curing.

2. The process of claim 1 wherein the internal heating is done by hot gases.

3. The process of claim 1 wherein the internal heating is done by electrical means.

4. The process of claim 1 wherein latent solvent evaporating from the coating is maintained in contact with the coated surface by a sealed enclosure having surfaces proximate to the coated surface.

5. The process of claim 1 wherein the heating is done in an enclosure and the latent solvent is maintained in contact with the coated surface by adding latent solvents to the atmosphere in the enclosure from an external source.

6. The process of claim 1 using an organosol which comprises polyvinyl fluoride and latent solvent.

7. The process of claim 1 using a plastisol which comprises polyvinyl fluoride and latent solvent.

* * * * *